United States Patent [19]

Rocco

[11] Patent Number: 4,938,355

[45] Date of Patent: Jul. 3, 1990

[54] CARRYING CASE FOR WET AND DRY PAINTING TOOLS

[76] Inventor: Joseph Rocco, 469 Zadig St., Oceanside, N.Y. 11572

[21] Appl. No.: 453,675

[22] Filed: Dec. 20, 1989

[51] Int. Cl.[5] ..... B65D 85/28

[52] U.S. Cl. ..... 206/372; 206/373; 220/DIG. 6; 312/DIG. 33

[58] Field of Search ..... 206/315.11, 361, 362, 206/372, 373, 375, 570, 571; 220/DIG. 6; 312/DIG. 33

[56] References Cited

U.S. PATENT DOCUMENTS

| | | | |
|---|---|---|---|
| 1,223,161 | 4/1917 | Fazzini | 206/373 |
| 1,667,044 | 4/1928 | Oddo | 206/362 |
| 3,549,064 | 12/1970 | Wilson | 206/373 |
| 3,831,805 | 8/1974 | Yonce | 206/373 |
| 3,878,939 | 4/1975 | Wilcox | 206/373 |
| 4,085,987 | 4/1978 | Vartdal | 312/DIG. 33 |
| 4,255,872 | 3/1981 | Williams, Sr. | 206/576 |
| 4,681,219 | 7/1987 | Kitchens | 206/373 |
| 4,819,800 | 4/1989 | Wilson | 206/373 |
| 4,834,237 | 5/1989 | Henke et al. | 206/373 |
| 4,852,930 | 8/1989 | Agee | 294/143 |

*Primary Examiner*—David T. Fidei

*Attorney, Agent, or Firm*—Notaro & Michalos

[57] ABSTRACT

A case for receiving a collection of wet and a collection of dry painting tools, comprises first and second case portions which are made of molded plastic and are hinged to each other. A plastic dry tool tray is connected to the first case portion and a plastic wet tool tray is connected to the second case portion. The dry tool tray is removable for opening additional interior storage space and the wet tool tray is hermetically connected to the second case portion for defining a liquid tight sealed interior drainage space. Wet tools are retained in recesses in the wet tool tray which are each provided with a raised lip and drainage opening for drainage liquids from the wet tools into the interior of the second case portion. Retaining lugs, blades or straps are provided for holding tools to the recesses. The case is closed with a combination lock and includes a recessed handle and clock.

20 Claims, 4 Drawing Sheets

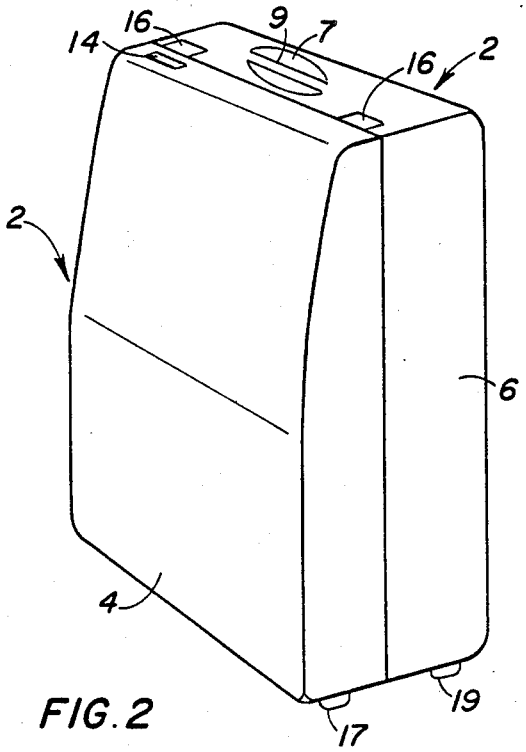
FIG. 2
FIG. 3
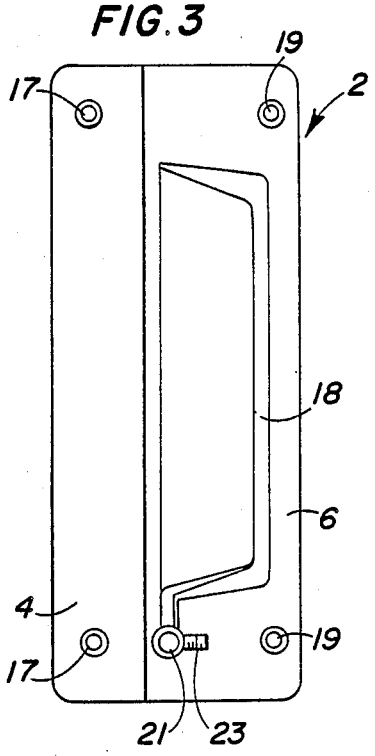
FIG. 7
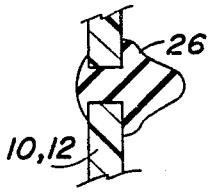
FIG. 6
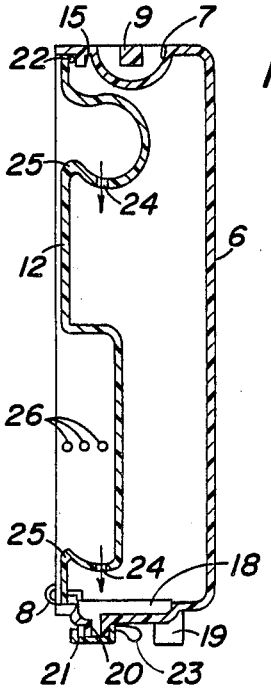

CARRYING CASE FOR WET AND DRY PAINTING TOOLS

FIELD AND BACKGROUND OF THE INVENTION

The present invention relates in general to specialized carrying cases, and in particular to a new and useful carrying case which is constructed for carrying a wide selection of painting tools, and for dividing the tools into tools used during the dry phase of a painting job which are carried on one side of the case, and tools used during the wet phase of a painting job which are carried on the other side of the case.

Professional painters currently use a wide variety of tools during the course of their work. These specialized tools are used not only for the actual painting job, but also for preparing the surfaces to be painted. Additional tools are used for maintaining and cleaning other tools. For example, a professional painter's collection of tools may include a brush comb, a brush and roller spinner, and a roller sleeve cleaner.

Despite the improved efficiency and convenience these specialized tools afford, a professional painter is still hampered by time wasted in assembling, transporting and selecting the correct tool for a particular phase during a painting operation. The wide variety of tools are often carried in open buckets in a mixed and disorganized condition.

Tools are often lost, inadvertently left at a working site, stolen or broken.

A mechanism and system of organizing the tools for transport and use would greatly facilitate a painter's job, whether it be a professional or amateur painter In addition, organization and standardization of professional painting tools would improve the quality of the painting job and enhance the professionalism and skill of the painter.

SUMMARY OF THE INVENTION

An object of the present invention is to provide a specialized carrying case for painting tools which organizes the wide variety of tools needed for a professional painting job, into a logical array of tools. According to the present invention, the tools are firmly held at receiving sites or recesses on two sides of a carrying case. The tools are divided into tools which are used for the dry phase of a painting operation, and tools which are used during the wet phase of a painting operation. The dry tools are positioned on one side of the carrying case while the wet tools are positioned on the other side of the carrying case. In each side of the carrying case, the tools are also organized in a sequential manner which approximately follows the normal sequence in which the tools are to be used on a job.

The recesses on the wet side of the carrying case are provided with a drainage arrangement so that, when the case is closed, free drainage is provided from each of the wet tools.

Advantageously, each portion of the case is made of rugged molded plastic. The multiple tool sites or recesses are provided on a pair of trays which are connected to the molded case portions. The tray on the dry side of the case is detachable connected so that the tray can be pivoted or lifted from that portion of the case, revealing a large interior compartment which can receive such things as protective clothing or plastic drop cloths. This somewhat hidden compartment can also be used for items such as keys which are better stored out of sight.

While the tray on the wet side of the case may be detachably mounted, when attached to the wet portion of the case, the tray must form a water tight seal with the case. This forms a water tight volume within the case which receives the drainage liquids from the wet tools stored in the recesses of the wet tray. Advantageously, each recess is provided with a drainage lip forming a shallow trough in the bottom of the recess. At least one drainage opening is provided at the bottom of each trough to allow for the free passage of liquid from the recess into the interior of the wet case portion. A main drainage opening is provided at the bottom of the wet case portion for draining liquids at appropriate locations such as a slop-sink or a curb side.

Other convenience and security features include a combination lock for closing the case, a digital clock embedded in the dry side of the case and a recessed handle for carrying the case.

Accordingly, a further object of the present invention is to provide a carrying case for painting tools comprising: a first case portion defining an interior space; a second case portion defining an interior space; a dry tool tray operatively connected to the first case portion for closing the interior space thereof, the dry tool tray having a plurality of dry tool sites distributed thereon each for receiving at least one separate dry tool for use during a dry operation of a painting job; a wet tool tray operatively connected to the second case portion for closing the interior space thereof, the wet tool tray having a plurality of wet tool recesses therein, each recess for receiving at least one wet tool for use during a wet operation of a painting job; connecting means operatively connected between the first and second case portions for connecting the case portions to each other in a closed position with the dry tool tray facing the wet tool tray, and for allowing movement of the first and second case portions into an opened position with the dry and wet tool trays facing in the same direction for free access to tools in the dry tool sites and tools in the wet tool recesses; each wet tool recess including recess drainage means for draining an interior of each recess into the interior space of the second case portion; and case drainage means connected to the second case portion for draining liquid from the interior space of the second case portion.

A further object of the present invention is to provide a carrying case for wet and dry painting tools which is simple in design, rugged in construction and economical to manufacture. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a perspective view of the carrying case in a closed position;

FIG. 3 is a bottom plan view of the case;

FIG. 6 is a sectional view taken along line 6—6 of FIG. 5 showing the wet tool tray and wet case portion of the carrying case; and FIG. 7 is a fragmentary sectional view on an enlarged scale showing one example of retaining means for retaining tools in the respective tool recesses.

DESCRIPTION OF THE PREFERRED EMBODIMENT

Figure 1:
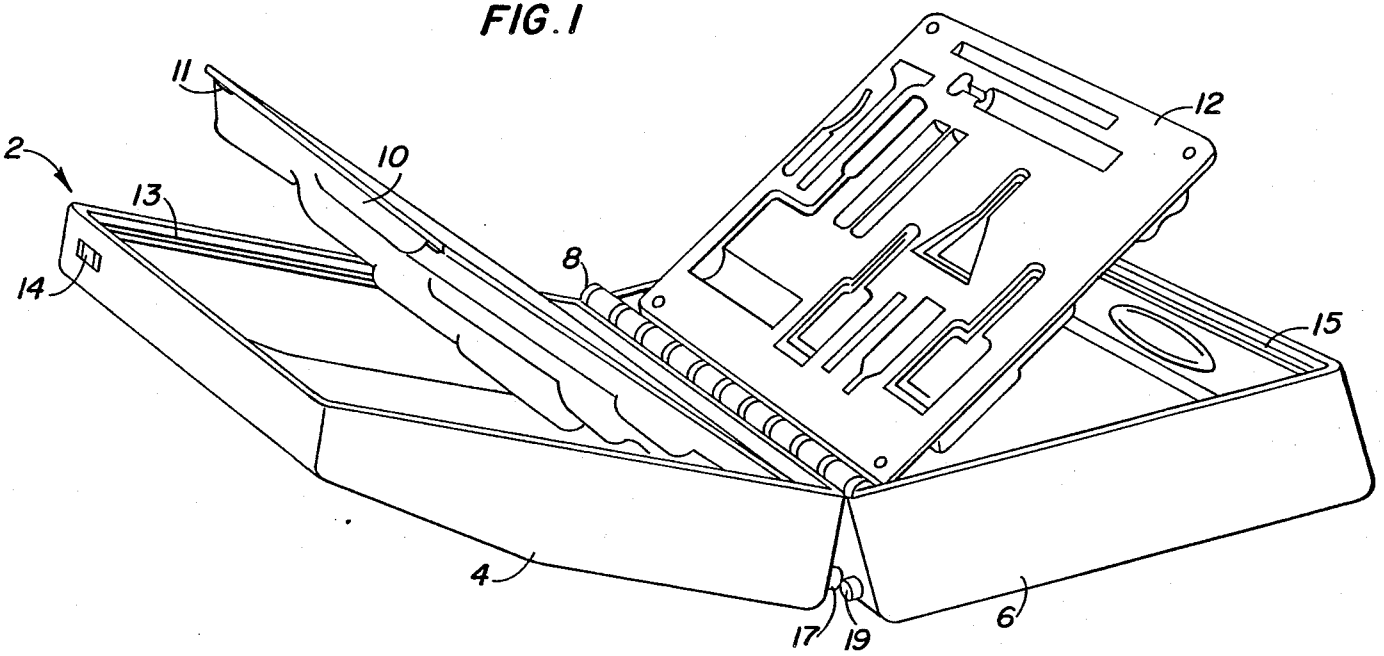
FIG. 1 is a perspective view of a carrying case according to the present invention, shown in an open position, with the wet and dry trays lifted from their respective wet and dry case portions.

Referring to the drawings in particular, the invention embodied in FIGS. 1, 2 and 3, comprises a carrying case generally designated 2 for painting tools to be used for a professional or amateur painting job.

The case comprises a first case portion 4 which has a lower outer edge that is hinged by a metal or plastic hinge 8 to the lower outer edge of a second case portion 6.

A dry tool tray 10 is detachable connected or articulated to the first case portion 4 so that it can be moved into an open position shown in FIG. 1. The interior space of case 4 can thus be accessed for receiving other paint related items such as protective clothing, drop cloths or cleaning cloths. The interior space can also be used for hiding such security items such as keys and money.

Articulation of tray 10 to case portion 4 may be provided by a hinge connected at the lower edge of the tray and case. Magnetic discs 11 can be used at the corners of tray 10 to engage magnetic or metal discs on a ledge 13 defined around the interior of case portion 4. Tray 10 is supported on the ledge and held against the ledge by the magnetic interaction of elements 11 and 13. Alternatively, manually operated latches may be used. Instead of a hinge connection, tray 10 can be provided with magnetic or mechanical latches around the case portion 4.

A wet tool receiving tray 12 can be detachably connected to case portion 6 in a similar manner. If a detachable connection is used, however, a hermetic seal in the form of a rubber ring 22 shown in FIG. 6, or other waterproof structure must be provided between the lower or outer surface of tray 12, and the interior of case portion 6, at a ridge 15 which is provided in the case portion 6 for supporting the tray 12. Alternatively, tray 12 is hermetically sealed and permanently connected to case portion 6 to define a hermetically closed inner space for receiving drainage liquids from the tray 12.

The upper surface of case portion 4 also advantageously includes a digital clock 14, such as a conventionally available digital LED or liquid crystal clock.

As best shown in FIG. 2, the upper surface of case portion 6 also has a concave handle recess 7 which is spanned by a rigid handle 9 for carrying the case. This avoids a protruding handle which may encumber free movement around the case when it is in its open position.

Six digit combination locks 16 are also provided at the upper surface of case portions 6 for interengaging a lock mechanism on the upper surface of case portion 4 for closing and locking the case.

Two projecting rubber feet 17 and 19 extend from the lower surfaces of respective case portions 4 and 6 as shown in FIG. 3.

As best shown in FIGS. 3 and 6, the lower surface of case portion 6 carries a drainage channel 18 which, with the case in its upright position shown in FIGS. 2 and 6, is inclined downwardly toward a main drainage opening 20 at the lowest point of the case portion 6, which is covered by a drainage cap 21. Drainage cap 21 is detachably threaded or snapped over opening 20 and may be retained by a loop 23 to the case 6 to avoid its being lost. The length of feet 17 and 19 is selected to maintain the drainage opening 20 above the bottom of the feet and thus allow free drainage.

Figure 4:
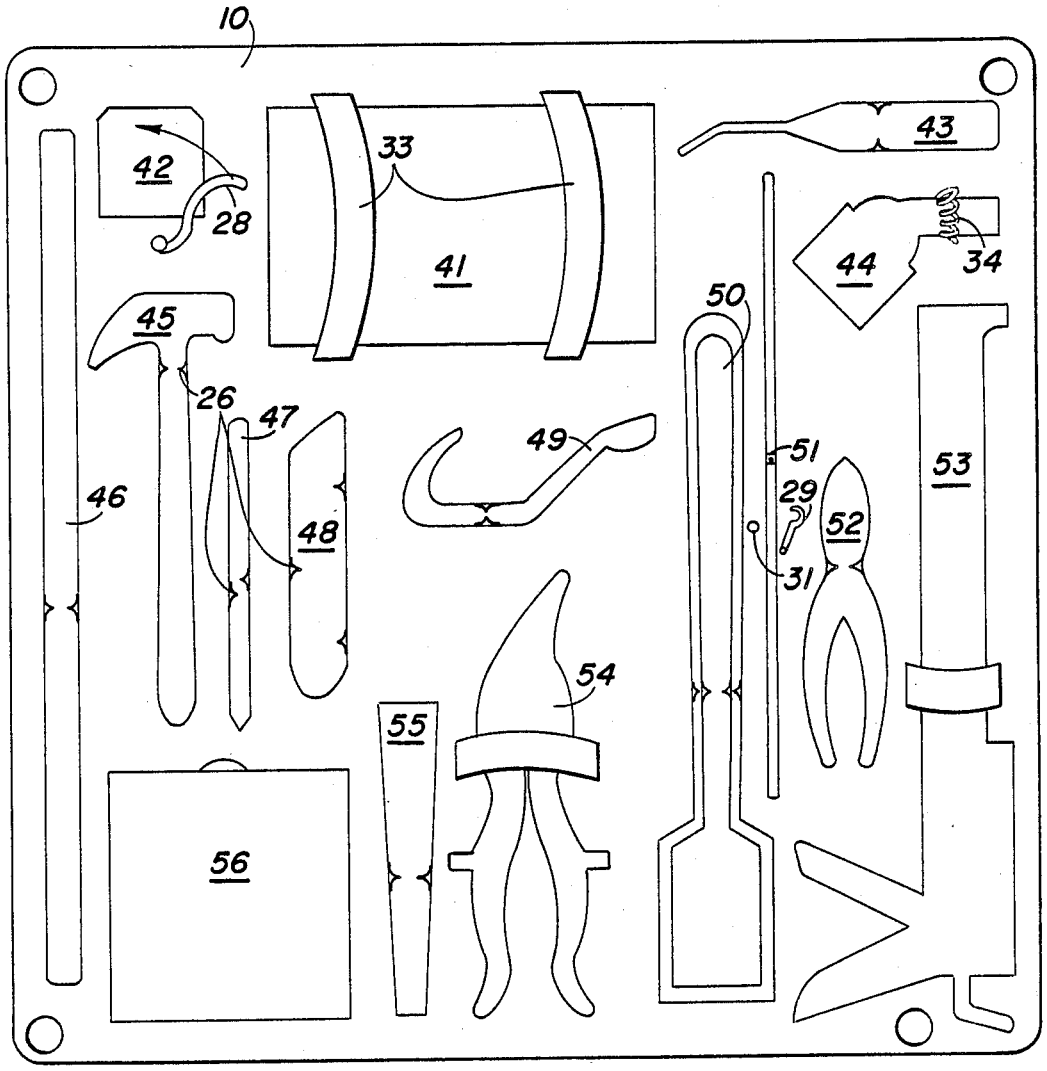
FIG. 4 is a top plan view of the dry tool tray of the carrying case.

As shown in FIG. 4, tray 10 comprises a dry painting tool tray which carries a plurality of dry tool sites in the form of recesses in a tray. Each recess is shaped like and carries an individual specialized tool for use during a dry operation of a painting job.

Figure 5:
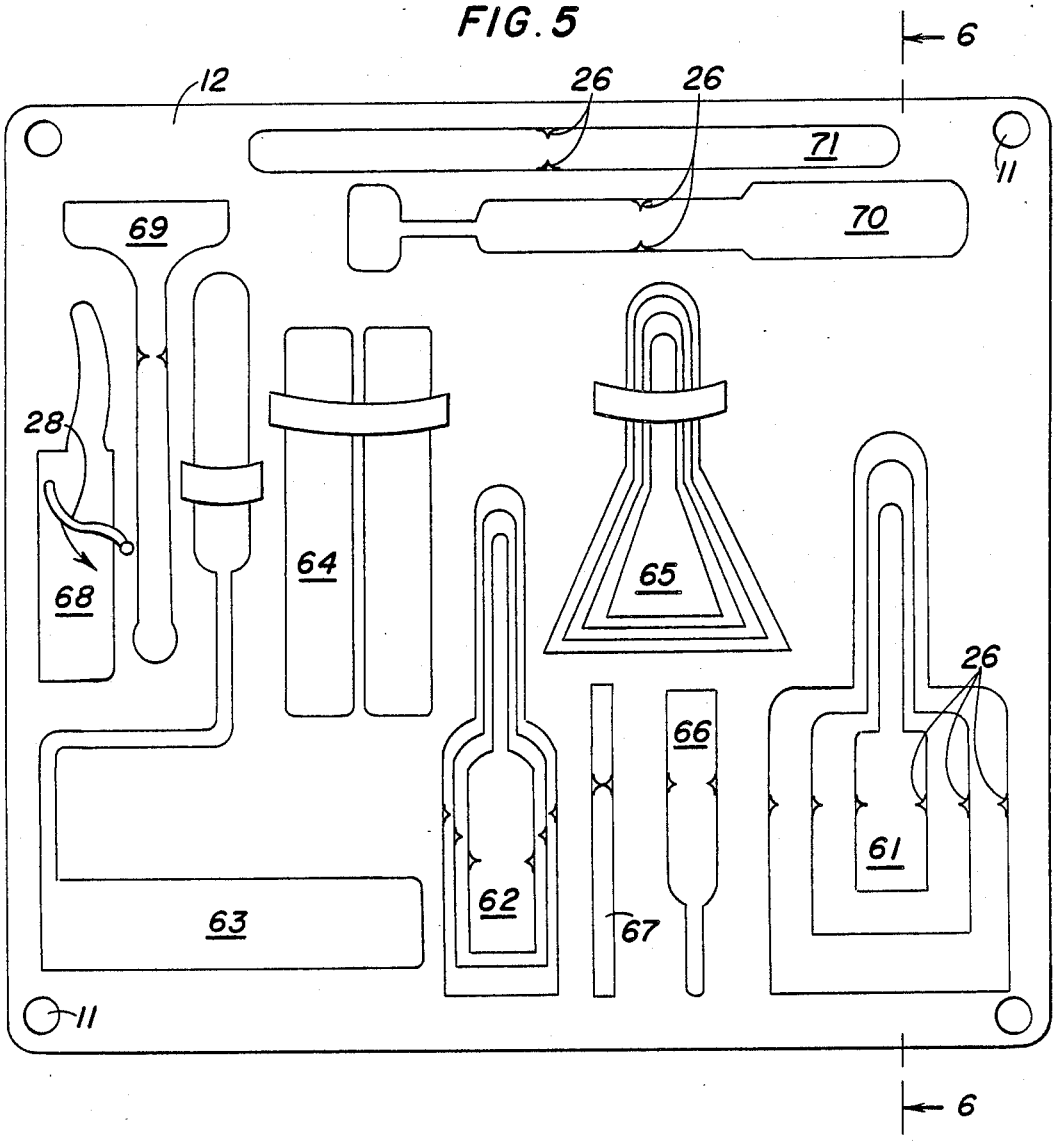
FIG. 5 is a top plan view of the wet tool tray of the carrying case.

As shown in FIG. 5, and in a like fashion, tray 12 carries a plurality of wet tool recesses.

The trays 10 and 12 as well as the case portions 4 and 5 are advantageously made of rugged molded plastic to provide a waterproof, durable and light structure.

As best shown in FIGS. 5 and 6, each of the recesses of the wet tool tray 12, has recess drainage means in the form of a lower raised lip 25 forming a shallow trough at the bottom of the recess, which is perforated by one or more drainage holes 24 which drains into the interior of case portion 6. In this way, liquid from each of the multiple tool recesses in tray 12 can be accumulated in the bottom of case 6 when the case is in its close and upright position.

Referring once more to FIGS. 4 and 5 the following is a listing of tools to be stored in each of the tool receiving recesses Each recesses is specially shaped to closely receive the one or more specialized tool and has its own retaining mechanism. Some of the recesses carry two or more opposed retaining lugs 26 which are advantageously made of rubber and, as shown in FIG. 7, have stems extending into openings in the respective tray 10 or 12. These lugs are replaceable to increase the useful life of the case. The flexible lugs yield for receiving or releasing a tool and, when the lugs wear out, they can be replaced by fresh lugs. Alternatively, projections or lugs can be molded into the body of the trays to act as retaining means for the tools.

Some of the tools are retained by retaining plates 28 which are pivotally mounted about axes extending normal to the respective trays, for swinging over and away from the tool held in the recess. The retaining plate 29 shown in FIG. 4 may be used in conjunction with a latch pin 31 which receives a hooked end of the plate 29 for even more securely holding a tool.

Elastic straps 33 are used for retaining tools in some of the recesses and a spring 34 is used to retain a tool in another one of the recesses.

Dry Tool Recesses:

41 - pole sander
42 - 6 to 8 foot tape measure
43 - crack opener
44 - brush pole extension handle
45 - hammer and screwdrivers
46 - three mixing sticks
47 - pencil holder
48 - sheet rock knife
49 - pot hooks
50 - two pull scrapers
51 - metal file
52 - pliers
53 - chalking gun 54 - metal sheer cutters
55 - window glazing knife
56 - free space and utility box Wet Tool Recesses:

61 - Recessed large multiple brush holder
1×4 inch brush
2×3 inch brushes
62 - Recessed small multiple brush holder
1×2.5 inch angle brush
2×2 inch angle brushes
3×1 inch angle brushes
63 - two 9 inch roller handles
64 - two 9 inch roller sleeves
65 - four spackle plaster knifes:
1×6 inch blade
1×5 inch blade
1×4 inch blade
1×1.25 inch blade
66 - combination roller sleeve cleaner and paint can opener
67 - brush comb
68 - wire brush
69 - wallpaper remover knife
70 - brush and roller spinner
71 - three part telescoping roller handle pole Each single tool or multiple tool recess is shaped to roughly correspond to the tool or tools it is designed to receive. This provides a clear and unambigious visual clue as to which tool belongs in which recess and, when the trays are full, which tools are missing. The tools are assembled to maximize packing space while at the same time avoiding confusion between and among tools.

Every tool which may be needed during a professional or amateur painting job has its own position in the case and appropriate retaining means are selected for each tool depending on the structural shape and physical characteristics of the tool. For example, the broad flat pole sander 41 which has a central projection for receiving a threaded pole, is provided with a pair of spaced elastic straps 33 which are positioned on opposite sides of the threaded connector for the pole sander. The tape measure in recess 42 is conveniently retained by a blade retainer 28. Hand tools such as a hammer and screwdriver in recess 45, a pencil in recess 47 or a sheet rock knife in recess 48 are retaining by rubber lugs 26. The thin heavy metal file 51 is retained by a blade 28 which has a hooked end for engaging pin 31 to securely retain the heavy tool. The brush pole extension handle recess 44 for retaining the brush pole extension handle with its articulated neck, it advantageously retained by spring 34.

While a specific embodiment of the invention has been shown and described in detail to illustrate the application of the principles of the invention, it will be understood that the invention may be embodied otherwise without departing from such principles.

What is claimed is:

1. A carrying case for painting tools comprising:

a first case portion defining an interior space;

a second case portion defining an interior space;

a dry tool tray operatively connected to the first case portion for closing the interior space thereof, the dry tool tray having a plurality of dry tool sites distributed thereon each for receiving at least one separate dry tool for use during a dry operation of a painting job;

a wet tool tray operatively connected to the second case portion for closing the interior space thereof, the wet tool tray having a plurality of wet tool recesses therein, each recess for receiving at least one wet tool for use during a wet operation of a painting job;

connecting means operatively connected between the first and second case portions for connecting the case portions to each other in a closed position with the dry tool tray facing the wet tool tray, and for allowing movement of the first and second case portions into an opened position with the dry and wet tool trays facing in the same direction for free access to tools in the dry tool sites and tools in the wet tool recesses;

each wet tool recess including recess drainage means for draining an interior of each recess into the interior space of the second case portion; and case drainage means connected to the second case portion for draining liquid from the interior space of the second case portion.

2. A case according to claim 1 wherein each of the plurality of dry tool sites comprises a recess in the dry tool tray, each of the recesses in the dry and wet tool trays being shaped to correspond to the outer contour of a tool for engagement in that recess, each recess including tool retaining means for retaining a tool therein.

3. A case according to claim 2 wherein the tool retaining means for at least some of the recesses comprise a plurality of elastic lugs for engaging a tool.

4. A case according to claim 2 wherein the tool retaining means for at least some of the recesses comprise an elastic band for retaining a tool.

5. A case according to claim 2 wherein the tool retaining means for at least some of the recesses comprise a blade moveably mounted to the tray for movement over and away from the recess equipped with the blade.

6. A case according to claim 2 wherein the tool retaining means for at least one of the recesses comprise a spring spanning a portion of the recess for retaining a tool therein.

7. A case according to claim 1 wherein the recess drainage means comprise each recess in the wet tool tray having a raised lip defining a shallow trough, and at least one drainage hole in the shallow trough.

8. A case according to claim 7 wherein the connecting means comprise a hinge connected to lower outer edges of the first and second case portions for pivotally mounting the first and second case portions to each other.

9. A case according to claim 8 wherein the lip of each recess in the wet tool tray is on a side of each recess closest to the hinge.

10. A case according to claim 9 wherein the case drainage means comprises a drain opening extending through a side of the second case portion which carries the hinge, and a cap removably covering the drainage opening.

11. A case according to claim 10 wherein the case draining means includes a channel in the side of the second case portion which carries the hinge for channelling liquid to the drain opening.

12. A case according to claim 1 including a digital clock connected to one side of the first case portion, the second case portion having an adjacent side with a handle recess therein and a handle spanning the handle recess for carrying the case when the case is in the closed position.

13. A case according to claim 12 including a lock for locking the case in the closed position.

14. A case according to claim 1 wherein the first and second case portions and the wet and dry tool trays are each made of formed durable plastic material, the connecting means comprising a hinge for hingedly connecting the first and second case portions to each other for movement between the open and close positions thereof.

15. A case according to claim 14 wherein each of the plurality of dry tool sites comprises a recess in the dry tool tray, each of the recesses in the dry and wet tool trays having retaining means thereon for retaining tools therein.

16. A case according to claim 15 wherein at least some of the tool retaining means comprises a plurality of replaceable elastic lugs detachably connected to the trays.

17. A case according to claim 14 wherein each of the recesses is shaped to correspond to an outer contour of a tool for engagement in that recess, the dry tool tray being detachably connected to the first case portion for movement with respect thereto for opening the interior space of the first case portion for additional storage.

18. A case according to claim 17 wherein the tool recesses of the dry tool tray include separate recesses which are shaped for individually receiving a hammer, at least one mixing stick, a knife and a scraper.

19. A case according to claim 17 wherein the wet tool tray is connected to the second case portion for hermetically sealing the interior space of the second case portion, recesses in the wet tool tray being shaped to correspond to the outer contour of wet tools for engagement therein, the wet tool tray including separate recesses for receiving at least one brush and at least one roller handle.

20. A case according to claim 19 wherein the recesses of the wet tool tray include at least separate recesses for at least one plaster knife and at least one telescopic roller handle pole.

* * * * *